United States Patent [19]

Marquardt et al.

[11] 4,035,596

[45] July 12, 1977

[54] ELECTRICAL SWITCH CONSTRUCTION

[75] Inventors: Erich Marquardt; Werner Storz, both of Rietheim; Kuno Futterknecht, Liptingen, all of Germany

[73] Assignee: J. & J. Marquardt, Germany

[21] Appl. No.: 664,422

[22] Filed: Mar. 8, 1976

[30] Foreign Application Priority Data

Mar. 13, 1975 Germany ..... 2510902

[51] Int. Cl.[2] ..... H01H 13/64; H01H 3/12

[52] U.S. Cl. ..... 200/159 A; 200/67 DB; 200/76; 200/275; 200/303

[58] Field of Search ..... 200/6 B, 67 A, 67 D, 200/67 DA, 67 DB, 76, 77, 159 R, 159 A, 239, 275, 303

[56] References Cited

U.S. PATENT DOCUMENTS

| | | | |
|---|---|---|---|
| 1,499,370 | 7/1924 | James | 200/159 A |
| 2,507,381 | 5/1950 | Morse | 200/159 A X |
| 3,073,934 | 1/1963 | Oakman et al. | 200/159 A |
| 3,786,205 | 1/1974 | Lien | 200/159 A X |
| 3,916,131 | 10/1975 | Golbeck et al. | 200/159 A |
| 3,997,745 | 12/1976 | Marquardt et al. | 200/76 |

*Primary Examiner*—Volodymyr Y. Mayewsky
*Attorney, Agent, or Firm*—McGlew and Tuttle

[57] ABSTRACT

A switch construction comprises a housing which has a base wall and an upstanding side wall with first and second contact terminals arranged in spaced locations in the housing and with one of them bent over on its top so as to form a contact making portion. A spring member has an upper part with one end engaged in a V-shaped bearing on the one contact terminal and has a lower part with a contact arm which is engageable with the contact portion of the other terminal. The upper and lower parts of the spring member are interconnected by a curved bearing portion which is engaged and supported in the housing sidewall. In addition the spring member has an intermediate part of the upper portion which is substantially straight and which is engageable by an extension of an actuation member which is engaged on the housing and confined for movement upwardly and downwardly within predetermined limits. The spring member biases the actuating member to an uppermost end position and it is movable downwardly against the spring member to cause a pivotal motion of the spring member upper part about the bulging portion at one end of the intermediate part and a bulging portion at an opposite end of the intermediate part. The lower part of the spring which includes the contact member is first moved in an upward direction by the downward movement of the actuating member and is thereafter moved into engagement with the contact portion of the second contact terminal.

7 Claims, 6 Drawing Figures

FIG.1
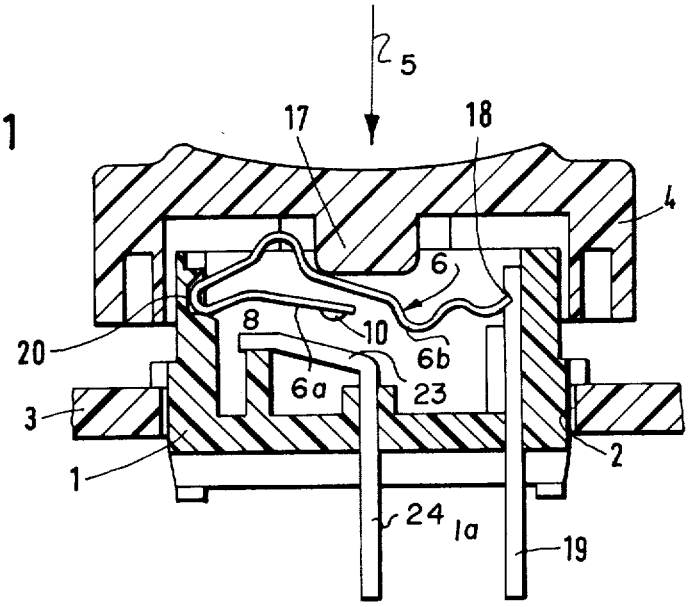
FIG. 2
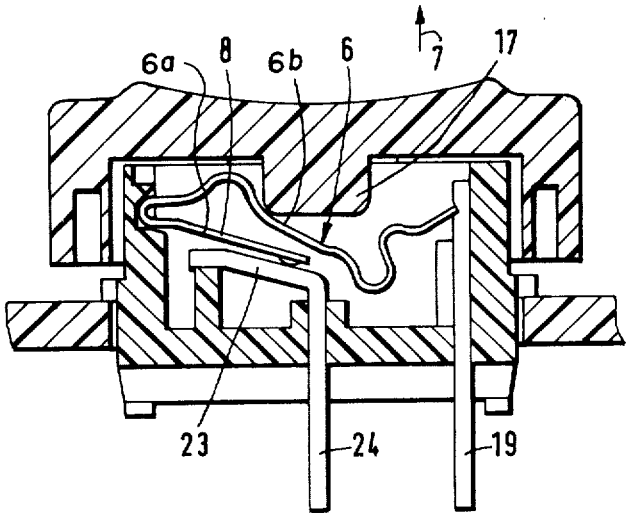
FIG. 3
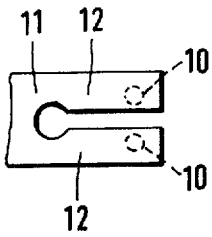
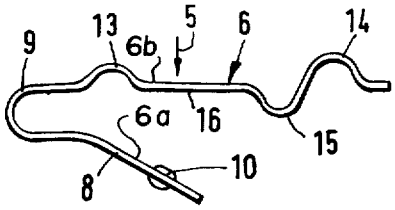
FIG. 4

ELECTRICAL SWITCH CONSTRUCTION

BACKGROUND OF THE INVENTION

1. Field of the invention

This invention relates in general to the construction of switches and in particular to a new and useful electrical switch which includes a spring member which is supported in a housing between a housing wall and a first contact terminal and which is deflectable by an actuating member engaged on the housing so as to bring a contact arm portion into engagement with a second contact terminal.

2. Description of the Prior Art

Switches of a general type which include a spring member which is deflectable by an actuating member are known. However, in various applications particularly in the data processing field there is a necessity for having a switch with a distinctly perceptible switching instant at the actuation. This is not achieved with the known designs of the prior art.

SUMMARY OF THE INVENTION

In accordance with the present invention there is provided a switch which is constructed so that the switching instant during a switching operation is clearly perceptible by the sense of touch.

In accordance with the invention the switch includes a spring contact member which has an upper part with one end engaged on a first terminal member seated in a housing and which includes a lower contact portion which is connected to the upper portion by a curved bearing portion which is seated in a wall of the housing. The upper portion of the spring member is engaged at an intermediate straight part by an extension of an actuation member which is movable upwardly and downwardly on the housing within confined limits. The arrangement of the spring member and the actuating member is such that the actuating force which is applied may be increased to a predetermined maximum and then after having risen to the maximum value will decrease. The result is that the switching instant at which the contact portion of the spring contact member moves into engagement with the contact portion of a second terminal is easily discernible on the actuation member. The actuation member may for example comprise a small key and thus the operator becomes aware of the fact that the switching has taken place or is just taking place. Advantageously, the switch is monostable, that is upon disappearing of the actuation force the spring and the contact arm return to their initial positions during which travel they reset the actuating member in those cases where no separate resetting mechanism or other reset means is provided. The characteristic for the back travel of the switch of the invention corresponds substantially to that of the forward travel for the actuation of the switching mechanism. A relatively long back travel of the key prior to the breaking off of the contact is also advantageous. In such a manner a relatively smooth separation of the contacting element is obtained. On the other hand for closing the movable contact applies abruptly against the fixed contact due to the variation of the actuation force during the switching. Scientific tests have shown that with a switch which has a tangible switching instant, the expended energy is smaller than with a switch without such a provision. This is probably due to the circumstance that with a conventional device the operator produces a greater effort because he is never quite sure whether the contact is in fact closed. To insure the closure in switches of the prior art the actuating member is pushed down to the extreme final position. With the inventive switch on the other hand the actuating member can be released shortly after reaching the switching instant and there is no need for making sure that the key abuts the housing for example. In considering that there are professions today which require an actuation of keys for hours, the extraordinary importance of a tangible switching instant of such a switch, particularly a key switch, becomes very clear. An increasing key force is termed a tactile swelling signal.

In a development of the invention one of the bearings of the bow type spring is connected in an electrically conducting manner to a terminal element of the switch. Consequently, the current can flow from the terminal through the bow type spring and the contact arms to the cooperating contact.

According to a further feature of the invention the switch includes a spring member with an upper part having an intermediate substantially straight portion located between a bulging portion at each end one of which is curved upwardly against the actuation direction and the other of which is curved downwardly in the direction of actuation. The actuation member advantageously applies against the intermediate portion and it is designed with a sufficient width so that it will not get clamped in one of the bulging portions or between the two bulging portions. Advantageously the switch also includes a lower portion which is connected to the upper portion by a curved bearing portion and which carries a contact arm which extends approximately parallel or at a small angle to the upper portion. The contact arm of course may be either straight or arcuate or angular. In the mounted state the spring member is biased against the actuation member and urges it into one end position that is an upper position. The spring member is advantageously made in one piece and includes the upper and lower portions interconnected by a curved bearing portion and with an upper portion having an intermediate substantially straight portion with a bulging part adjacent each end. The cross-section of the spring member is similar to a leaf spring in construction and of course the member must be of electrically conducting material.

In accordance with a feature of the invention the free end of the spring is advantageously supported in a V-shaped bearing notch which is formed in a first lug member which is engaged through the bottom of the housing and is positioned in an upright position along one side thereof. This feature makes the construction very inexpensive to manufacture and requires only a very few parts. The other end of the spring at the location of the curved bearing portion is engaged in a recess of the housing so that the spring may pivot in such location.

The lower portion of the spring member advantageously is befurcated so that there are two contact arm portions and each one carries a bead preferably a golden contact element. When the spring member is made in a single piece the entire switch assembly can comprise only five component parts including the first and second terminals, the housing, the spring member and the actuating member. Both the housing and the actuating member or keys are advantageously made of a plastic material.

Accordingly it is an object of the invention to provide an improved switch construction which comprises a housing having first and second spaced contact terminals therein and with a spring member having first and second parts which are interconnectable by a curved bearing portion which is positioned in a recess in a wall of the housing and which includes an upper part having an intermediate part which is engaged with an actuating member which is movable upwardly and downwardly on the housing, the spring member being constructed with a bulge on each side of the intermediate straight portion so that it may move downwardly under the force of the actuation member by a predetermined amount before the contact portion is switched into contact with the second contact member and wherein the movement of the contact into engagement is discernible through the actuator.

A further object of the invention is to provide a switch which is simple in design, ruggen in construction and economical to manufacture.

For an understanding of the principles of the invention reference is made to the following description of a typical embodiment thereof as illustrated in the accompanying drawings.

BRIEF DESCRIPTION OF THE DRAWINGS

In the Drawings:

FIG. 1 is a vertical sectional view of a switch constructed in accordance with the invention;

FIG. 2 is a view similar to FIG. 1 with the switch shown in an actuated position;

FIG. 3 is a partial top plan view of a portion of a spring contact member;

FIG. 4 is a side elevational view of the spring contact member;

GENERAL DESCRIPTION OF THE PREFERRED EMBODIMENT

Figure 5:
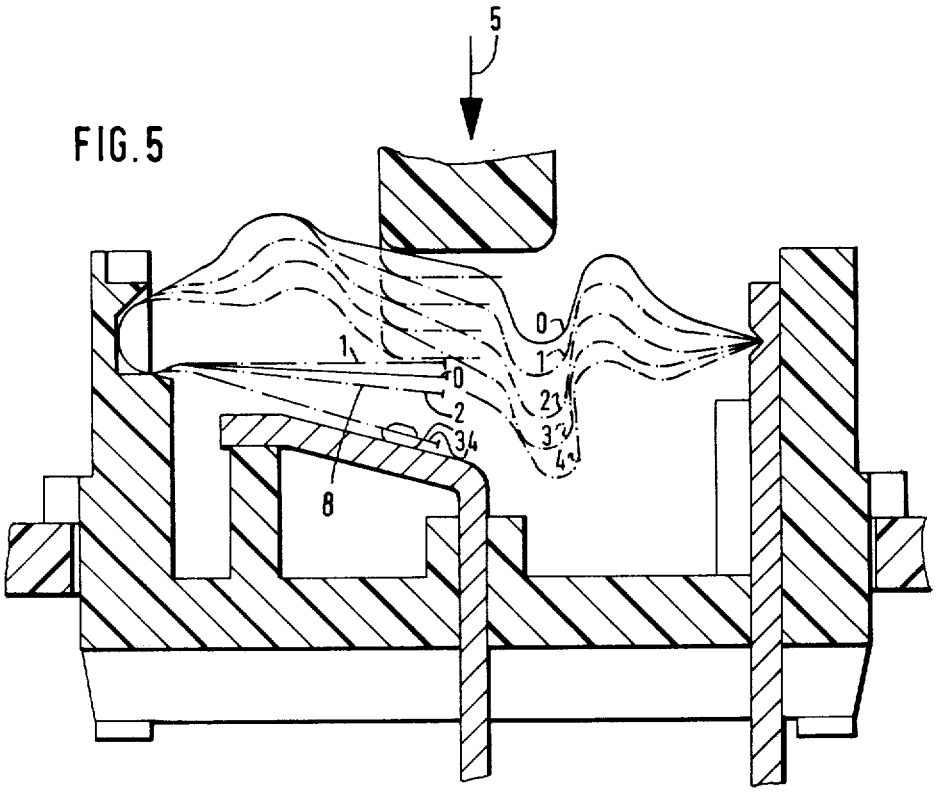
FIG. 5 is an enlarged view similar to FIG. 1 showing the positions of actuation and the various positions of the contact member.

Referring to the drawings in particular the invention embodied therein comprises a switch which is a single pole key button switch and which includes a housing 1 having a base 1a through which first terminal member 19 and a second terminal member 24 are engaged. In the embodiment illustrated the housing 1 is shown as positioned in a recess 2 of a plate member 3 which may be part of a calculator for example. An actuation member or key button 4 is engageable over the housing 1 and it is confined or trapped for movement upwardly and downwardly in respect to the housing between defined limits. The actuation member 4 is movable downwardly in the direction of arrow 5 in the actuation direction and is movable in a return direction in the direction of the arrow 7 shown in FIG. 2.

In accordance with the invention a spring member generally designated 6 has a first or lower portion 6a in the form of a contact arm 8 which is engageable with a contact portion 23 of the second terminal contact member or lug 24.

In the normal position of the spring member 6 shown in FIG. 1 it acts upon a central extension or projection 17 of the actuating member 4 and urges the actuating member upwardly to the uppermost end position. In this position the spring member 6 is in a biased state.

Advantageously the spring member 6 is manufactured in a single piece and includes a contact arm 8 which as shown in FIG. 3 may be bifurcated and have two leg portions 12, 12 each with a contact bead or button 10. FIG. 4 shows the unbiased condition of the spring member 6 in which the contact arm 8 extends at an angle to the upper portion 6*b*. the upper portion 6*b* includes an intermediate straight part 16 with an upwardly bulging portion 13 on one end and a downwardly bulging portion 15 on the opposite end. The downwardly bulging portion 15 which extends in the actuation direction 5 is connected at its outer end to an upwardly bulging portion 14 which in turn is connected to a terminating portion or end which is engaged in a V-shaped bearing 18 of the first contact terminal 19. Both the bulging portion 13 and the bulging portion 14 are curved upwardly or in a direction opposite to the actuation direction indicated by the arrow 5. Bulging portion 15 blends directly into the bulging portion 14.

As shown in FIG. 1 the stud-shaped extension 17 of the key 4 projects into the interior of the housing 1 and permanently applies against the connecting intermediate portion 16. More exactly expressed the spring 6 is inserted into the housing 1 in a biased state and urges the key 4 through the intermediate portion 16 into the upper end position thereof.

The upper bulging portions 13 and 14 serve to accommodate the horizontal spreading of the spring member caused by the biasing while the lower bulging portion 15 provides a pivotal radius during the actuation movement of the spring. The force resulting from the bias at the actuating key is very small.

Figure 6:
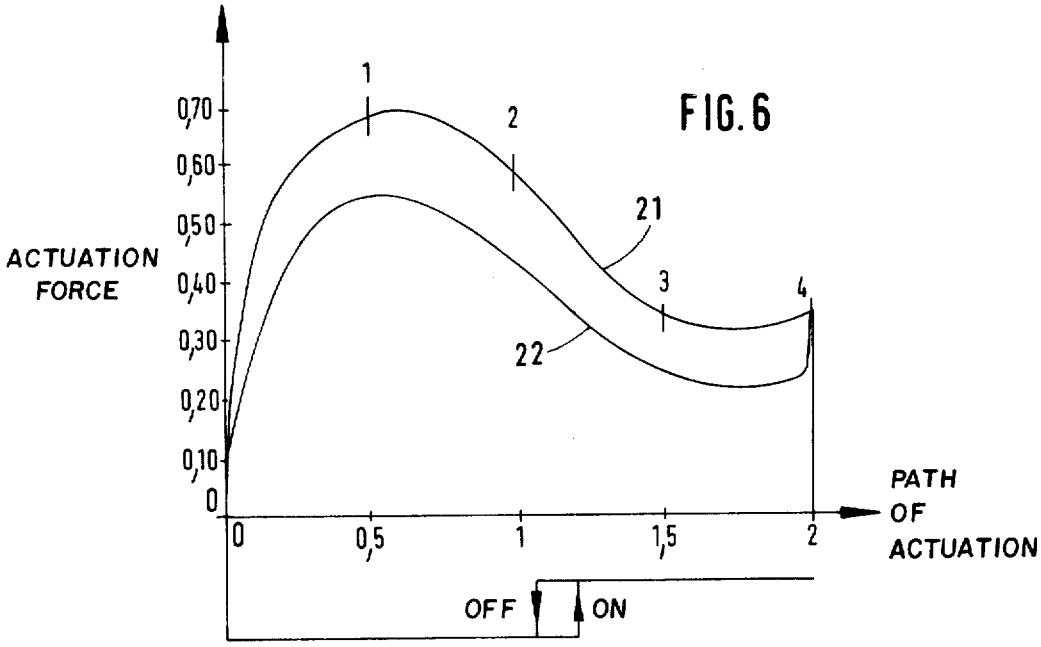
FIG. 6 is a curved showing an actuation force and the path of actuation during the on and off movement of the actuation member.

FIG. 5 indicates various phases of switch operation namely phase 0, 1, 2, 3 and 4. These same phases are indicated on the curve shown in FIG. 6 in which the values of the actuating force for the various stages of path movement of the actuating member 4 are indicated. Upon actuation the spring 6 while pivoting in both bearings moves toward the interior of the switch housing and deforms downwardly. In the initial phase the contact arm 8 moves first against the direction of actuation 5 and only subsequently in the same direction. This results in a characteristic shown in FIG. 6 where the switching phases from 0 to 4 are indicated on an upward curve 21 which is the actuation curve. The same phase occur in a lower return curve 22 which shows the relation during the resetting of the component parts. At the bottom of the curve the on and off positions are indicated symbolically. It will be noted therefrom for example during the switch off operation that the contact remain in contact relatively long for a relatively long period of time so that the key can travel through approximately one half it its path before the contacts are separated from each other. During the closing of the contacts the inventive switch behaves similarly. Thereby a smooth opening as well as a smooth closing of the contacts is obtained.

The invention thus provides a switch which can be made up of only five separate components namely the housing 1, the spring member 6, the first contact terminal 19, the second contact terminal 24 and the actuating member or key 4.

While a specific embodiment of the invention has been shown and described in detail to illustrate the application of the principles of the invention, it will be understood that the invention may be embodied otherwise without departing from such principles.

What is claimed is:

1. A switch construction comprising a dielectric housing, first and second contact terminals arranged at spaced locations in said housing, said first contact terminal having a spring contact member bearing a receiving recess, a spring contact member having a lower contact arm portion overlying said second contact terminal and being engageable with said second contact terminal for completing a circuit between said first and second contact terminals, said spring contact member having an upper actuation arm portion having an end engaged in said first contact terminal bearing receiving recess, said spring contact member having a curved bearing portion interconnecting said lower contact arm portion with said upper actuation arm portion, said housing having a housing recess, said curved bearing portion being engaged in said housing recess, said spring member having a substantially straight intermediate portion and with an upwardly bulging art adjacent one end of said intermediate portion which is adjacent to said housing recess and a downwardly bulging part adjacent the opposite end of said intermediate portion which is adjacent to said first contact terminal, and an dielectric actuation member engaged on said dielectric housing and connected thereto for limited upward and downward movement thereon and having an extension portion engaged with said spring member intermediate portion and being biased into an uppermost end position by said spring member, said actuation member being movable downwardly to cause said extension portion to bear against the intermediate portion and deflect it so that the downwardly bulging portion forms a radius of pivotal movement thereof, said curved bearing portion of said spring contact member permitting pivotal movement of said spring member and said lower contact arm portion downwardly toward said contact portion of said second contact terminal into engagement therewith.

2. A switch construction according to claim 1, wherein said housing includes a base and a side wall extending upwardly from said base, said first and second contact terminals extending through said base, said second contact terminal being located adjacent said side wall of said housing on one side thereof, the opposite side of said housing having said housing recess accommodating said curved bearing portion of said spring member.

3. A switch according to claim 1, wherein said second contact terminal includes an upper portion which is bent downwardly to form a contact making part which is engaged by said contact arm portion of said spring member.

4. A switch construction according to claim 1, wherein said actuation member includes a projection having a flattened bottom surface engageable over the intermediate substantially straight portion of said contact member.

5. A switch according to claim 1, wherein said spring member upper and lower portions are substantially parallel to each other.

6. A switch according to claim 1, wherein said first contact terminal receiving recess is V -shaped.

7. A switch construction according to claim 1, wherein said contact arm has a bifurcated end with two contact leg portions, each having a contact bead.

* * * * *